US010309729B2

(12) United States Patent
Bungo et al.

(10) Patent No.: US 10,309,729 B2
(45) Date of Patent: Jun. 4, 2019

(54) HEAT EXCHANGER CORE

(71) Applicant: T.RAD Co., Ltd., Tokyo (JP)

(72) Inventors: Takuya Bungo, Tokyo (JP); Atsushi Okubo, Tokyo (JP); Taiji Sakai, Tokyo (JP); Hirotaka Ueki, Tokyo (JP); Kazuo Maegawa, Tokyo (JP)

(73) Assignee: T.RAD Co., Ltd., Tokyo (JP)

( * ) Notice: Subject to any disclaimer, the term of this patent is extended or adjusted under 35 U.S.C. 154(b) by 38 days.

(21) Appl. No.: 15/309,927

(22) PCT Filed: May 25, 2015

(86) PCT No.: PCT/JP2015/065704
§ 371 (c)(1),
(2) Date: Nov. 9, 2016

(87) PCT Pub. No.: WO2015/182782
PCT Pub. Date: Dec. 3, 2015

(65) Prior Publication Data

US 2017/0153068 A1 Jun. 1, 2017

(30) Foreign Application Priority Data

May 27, 2014 (JP) ..... 2014-109171

(51) Int. Cl.
*F28F 1/12* (2006.01)
*F28F 1/32* (2006.01)
(Continued)

(52) U.S. Cl.
CPC ..... *F28F 1/128* (2013.01); *F25B 39/00* (2013.01); *F28D 1/0535* (2013.01); *F28F 1/325* (2013.01);
(Continued)

(58) Field of Classification Search
CPC ... F28D 1/02; F28D 1/04; F28D 1/053; F28D 1/0535; F28F 1/10; F28F 1/12;
(Continued)

(56) References Cited

U.S. PATENT DOCUMENTS 4,469,167 A * 9/1984 Itoh ..... F24F 13/30 165/151
4,615,384 A * 10/1986 Shimada ..... F28F 1/128 165/152
(Continued)

FOREIGN PATENT DOCUMENTS

JP 59-107190 A 6/1984
JP 63-131993 * 6/1988 ..... F28F 1/12
(Continued)

OTHER PUBLICATIONS

JP 63-131993 Machine Translation.*
Machine Translation JP 63131993 (Year: 1988).*

*Primary Examiner* — Keith M Raymond
*Assistant Examiner* — Gustavo A Hincapie Serna
(74) *Attorney, Agent, or Firm* — Norris McLaughlin, P.A.

(57) ABSTRACT

A corrugated fin heat exchanger is provided in which the direction in which louvers are cut and raised is inclined in one direction only, and in which heat transfer performance is improved above that of conventional fins. To accomplish this, the relationship $H>Qup/(Qup-1)\times\Delta H$ is satisfied.
H represents the core height of the heat exchanger,
Qup represents the ratio of the amount of heat exchanged per corrugation between one-directional louver fins and multi-directional louver fins in an airflow part,
and $\Delta H$ represents the amount of increase in a heat transfer reduction region of a heat exchanger core as a result of changing from multi-directional louver fins to one-directional louver fins.

1 Claim, 7 Drawing Sheets

(51) Int. Cl.
*F25B 39/00* (2006.01)
*F28D 1/053* (2006.01)

(52) U.S. Cl.
CPC ..... *F28F 2215/04* (2013.01); *F28F 2215/08* (2013.01)

(58) Field of Classification Search
CPC .... F28F 1/128; F28F 1/32; F28F 1/325; F28F 2215/00; F28F 2215/04; F28F 2215/08; F28F 2250/102; F25B 39/02
USPC ..... 165/148, 151, 152
See application file for complete search history.

(56) References Cited

U.S. PATENT DOCUMENTS 4,693,307 A * 9/1987 Scarselletta ..... F28F 1/128 165/152
5,035,052 A * 7/1991 Suzuki ..... F28F 1/128 165/151
5,289,874 A * 3/1994 Kadle ..... F28F 1/128 165/152
5,311,935 A * 5/1994 Yamamoto ..... B60H 1/00328 165/152
6,073,686 A * 6/2000 Park ..... F28D 1/05391 165/110
6,401,809 B1 * 6/2002 Zhang ..... F28F 1/128 165/111
7,721,794 B2 * 5/2010 Heidenreich ..... F28D 1/024 165/153
2003/0136554 A1 * 7/2003 Hu ..... F28F 1/128 165/151
2007/0144714 A1 6/2007 Yabe et al.
2008/0142202 A1 * 6/2008 Hu ..... F28D 1/0391 165/151
2008/0179048 A1 * 7/2008 Yaezawa ..... B21D 13/04 165/152
2012/0227945 A1 * 9/2012 Taras ..... F28D 1/05391 165/172
2013/0153174 A1 * 6/2013 Taras ..... F28F 1/022 165/104.19
2013/0248150 A1 * 9/2013 Ninagawa ..... F28F 1/325 165/104.19

FOREIGN PATENT DOCUMENTS

JP 63-131993 A 6/1988
JP 63131993 A * 6/1988 ..... F28F 1/12
JP 2003-050095 A 2/2003
JP 2003-214790 A 7/2003
JP 2006-266574 A 10/2006
JP 2007-178015 A 7/2007

* cited by examiner

HEAT EXCHANGER CORE

BACKGROUND OF THE INVENTION

The present invention relates to a corrugated-fin-type heat exchanger in which a direction of louvers formed on a fin is formed by cutting and raising in one direction only.

The corrugated-fin-type heat exchanger includes a number of flat tubes and a number of corrugated fins alternately aligned in parallel to each other to flow first fluid in the tubes, and flow second fluid on an outer face side of the tubes and in the corrugated fins.

The second fluid is mainly gas such as air.

In such a corrugated-fin-type heat exchanger, the fins currently used include a multi-directional louver at a mid-point and, at both sides of the multi-directional louver, louvers that are cut and raised in one incline direction and louvers that are cut and raised in mutually opposite incline directions.

Subsequently, the corrugated-fin-type heat exchanger limiting a direction of the louvers to one direction only is suggested in Japanese Patent Laid-Open No. 2006-266574.

The heat exchanger includes one-directional louvers that have an acute angle toward a flow-in direction of air flow and are formed by being cut and raised all over a length of a core width. According to that invention, it is pointed out that, with the fin cut and raised in the one direction all over the length of the core width, the air flow stagnates at an upper end portion and a lower end portion of the core.

Thus, according to that invention, a spacer member forming a space portion is disposed between each of tanks disposed above and below the core and each of the end portions of the fins. It is described, therefore, the stagnation of the air flow in the fin is reduced by providing the space portion to greatly reduce air flow resistance.

SUMMARY OF THE INVENTION

However, according to discussion of fluid analysis, experiments, and the like, by the inventor of the present invention, in the core including the corrugated fin with louver cut and raised in the one direction, performance of heat exchange cannot be more improved than that of the core of the conventional-type fin, until a core height, and a core width, and the cutting and raising angle are adjusted.

The present invention is developed based on the above described knowledge.

The present invention is a heat exchanger core in which a number of corrugated fins being aligned in parallel in a width direction of fins where fluid flows and including louvers all processed by being cut and raised to incline in a same direction (hereinafter, one-directional fin), and a number of flat tubes are alternately aligned in parallel to each other, wherein a core height H (mm), a cutting and raising louver width W (mm) in a main flow direction of the fluid, and a cutting and raising louver angle θ are set to satisfy an inequation (1) as below.

$$H>Qup/(Qup-1)\times\Delta H \quad (1)$$

$$Qup=Qup(W,\theta)=\alpha(W)+\beta(W,\theta)+1 \quad (2)$$

$$\alpha(W)=\eta/(W-\eta) \quad (3)$$

$$\beta(W,\theta)=\xi/(W\cdot\tan^2 2\theta-\xi) \quad (4)$$

$$\Delta H=\Delta H(W,\theta)=j\cdot W(\sin\theta+k\cdot\sin^2\theta) \quad (5)$$

$\eta$=0.3553 (mm)

$\xi$=0.5447 (mm)

j=0.1419 k=4.2789

According to the present invention, a core height H (mm), a cutting and raising louver width W (mm) in a main flow direction of fluid, and a cutting and raising louver angle θ satisfy above inequation (1).

Since the core height H satisfies $$H>Qup/(Qup-1)\times\Delta H,$$

compared to the conventional-type fins, performance of heat exchange is improved.

More specifically, a W-H curve line illustrated in FIG. 6 has the core height H in an range over a curve line connecting each point plotted at the cutting and raising angle θ of each louver. Note that, in FIG. 3, the cutting and raising louver width W refers to an range where one-directional louver is cut and raised.

Reasons of obtaining effects will be described below.

The one-directional fin has a disadvantage and advantage over the conventional multi-dimensional louver fins. One of the disadvantages is an increase ΔH of an air-flow reduced region (heat transfer reduction region), and one of the advantages is improvement (ratio) Qup of heat transfer in an air-flow portion.

Here, a condition for the advantage to exceed the disadvantage is to satisfy, $$Qup\times(H-\Delta H)/H>1.$$

The above inequation is modified, $$H>Qup/(Qup-1)\times\Delta H$$

is obtained.

DETAILED DESCRIPTION OF THE INVENTION

Subsequently, with reference to figures, an embodiment of the present invention will be described.

Figure 1:
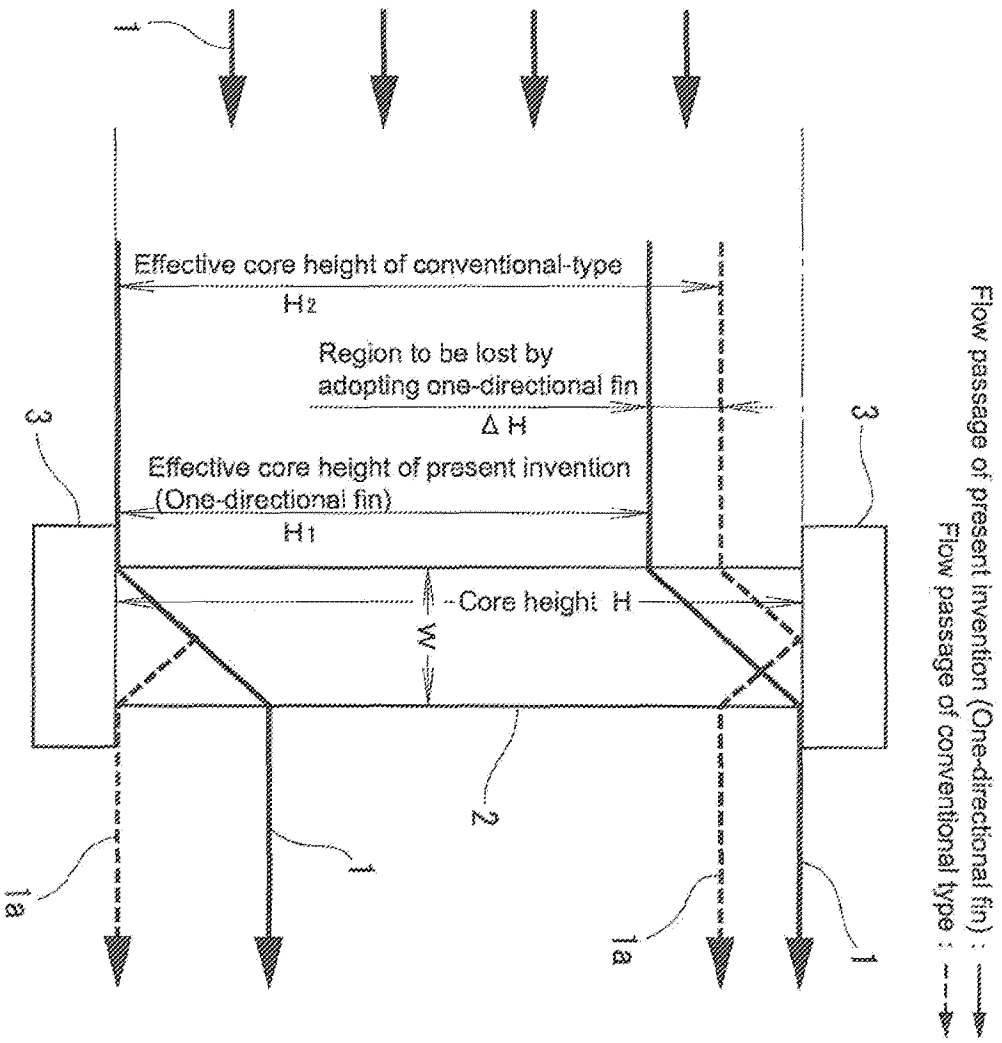
FIG. 1 illustrates comparison between an air flow by fins of the present invention and that by fins of the conventional-type heat exchanger.

FIGS. 1 to 3 illustrate comparisons between the heat exchanger core of the present invention and that of the conventional type that is currently practically used, respectively.

Figure 2A:
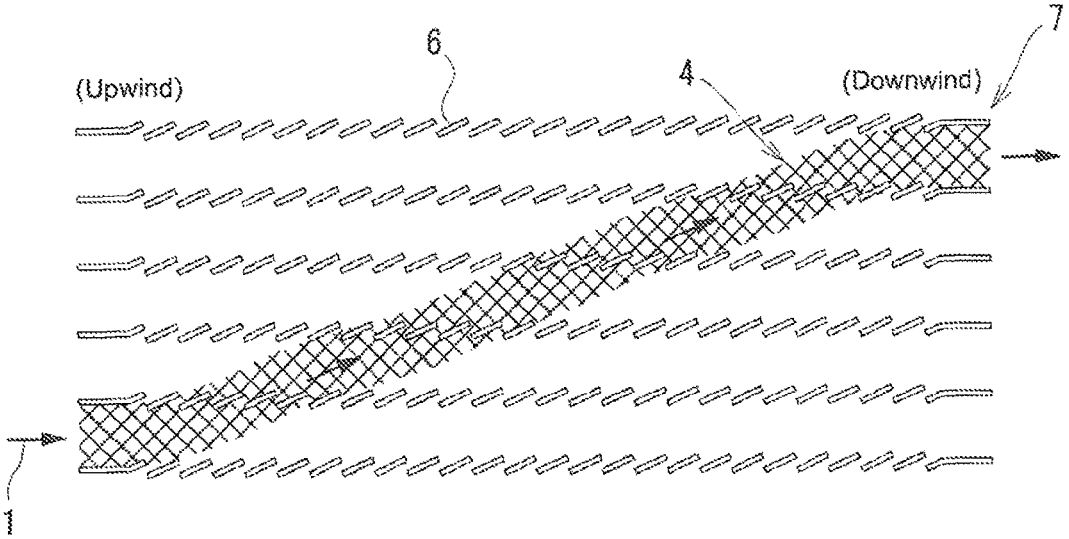
FIG. 2(A) illustrates a flow state of airflow of the present invention.
Figure 2B:
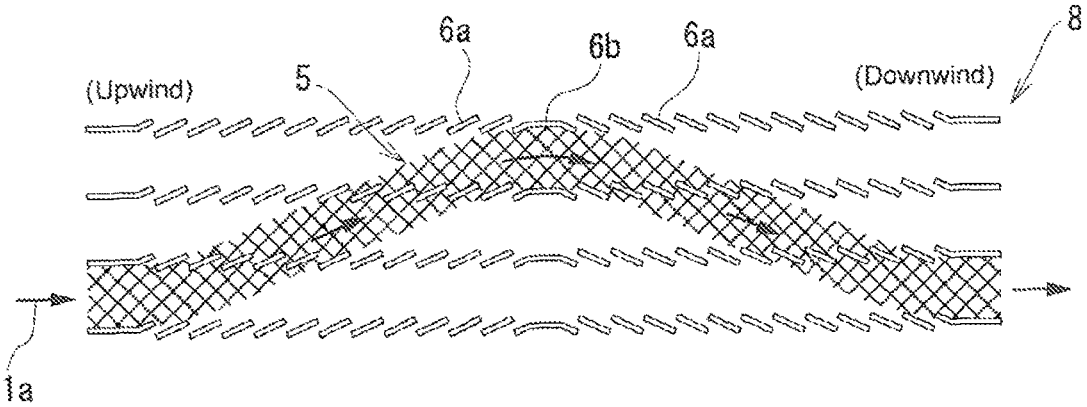
FIG. 2(B) illustrates a flow state of airflow of the conventional-type heat exchanger.
Figure 3A:
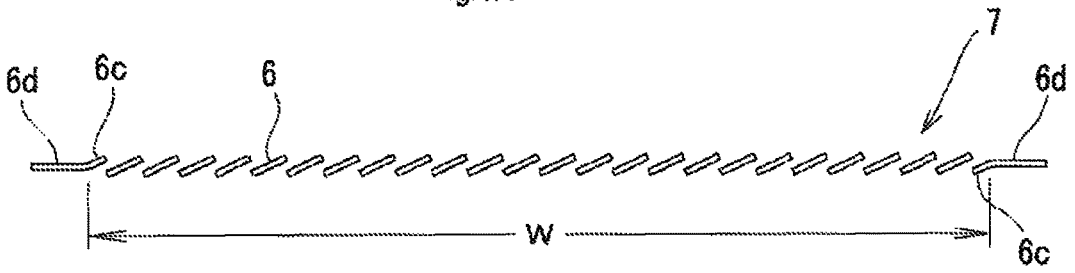
FIG. 3(A) illustrates cutting and raising of louvers of a heat exchanger core of the present invention.
Figure 3B:
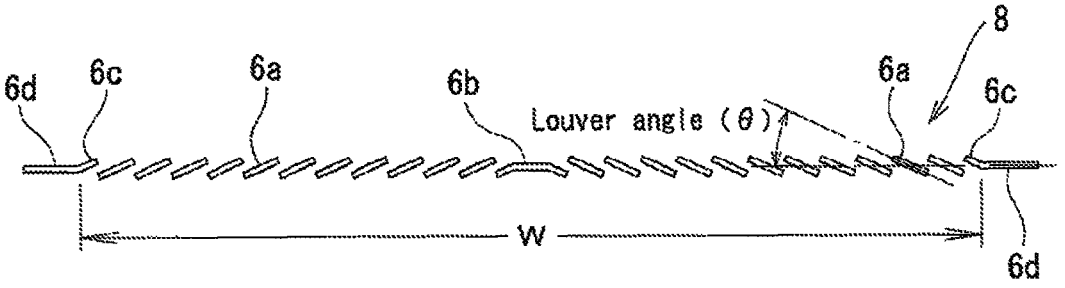
FIG. 3(B) illustrates cutting and raising of louvers of a conventional-type heat exchanger.

FIG. 1 is a vertical sectional view of the heat exchanger core. Further, FIG. 2(A) illustrates a flow passage of the air with the louvers of the present invention. FIG. 2(B) illustrates a flow passage of the air with the conventional-type core. FIGS. 3(A) and 3(B) illustrate a cut and raised state of each louver, respectively.

The heat exchanger core of the present invention is formed with a core in which flat tubes and corrugated fins are alternately aligned in parallel. In this example, a pair of tanks 3 are disposed above and below the core, and both ends of the flat tube pass through the tanks 3. In FIG. 1, the core height H is a separation distance between the pair of tanks 3 above and below the core (height of the space portion between the pair of tanks 3). The cutting and raising louver width W of the core is shorter than the width of the core illustrated in FIG. 3 by a length of flat portions of the fin.

In this example, as illustrated in FIGS. 2(A) and 3(A), the only one-directional fins are inclined as the corrugated fin, and cut and raised with the same pitch in the area of the cutting and raising width W of the louver. Further, at the both sides of the cutting and raising louver width W, a flat portion 6*d* is provided, and a half louver 6*c* is formed at the flat portion 6*d*. The width of the half louver 6*c* is as half as that of the louvers 6 other than the half louver 6*c*.

As illustrated in FIG. 2(A), upon airflow 1 coming into a one-directional fin 7, the airflow 1 is guided into each louver 6 of the one-directional fin, so that a flow passage 4 in one direction is formed in an oblique-band-like shape from an upstream side to a downstream side.

On the other hand, as illustrated in FIGS. 2(B) and 3(B), a conventional-type fin 8 includes a multi-directional louver 6*b* at a center of the fin in a width direction. At both sides of the multi-directional louver 6*b*, the louvers 6*a* having different directions from each other are aligned in parallel. At the both sides of the multi-directional louver 6*b*, a half louver is cut and raised.

Upon the airflow 1 coming into the conventional-type fin 8, as illustrated in FIG. 2(B), a flow passage 5 of the conventional-type fin is formed in a mountain-like shape.

As described above, the one-directional fin 7 that is an object of the present invention is totally different from the conventional-type fin 8 just like between the flow passage 4 of the one-directional fin and the flow passage 5 of the conventional-type fin.

That is based on configurational difference between the one-directional fin 7 of the present invention and conventional-type fin 8. Therefore, following differences are generated.

First of all, the one-directional fin 7 can have more louvers 6 compared to the conventional-type fin 8. This is because, in place of the multi-directional louver 6*b* of the conventional-type fin 8, the one-directional louver can be cut and raised. At this point, the core of the present invention improves a heat transfer ratio.

Subsequently, it is difficult to completely convert a direction of the airflow 1 with the multi-directional louvers 6*b*. The conventional-type fin 8 generates a stagnant region right after a direction-converting portion in a downstream direction, but the present invention does not generate the stagnant region. At this point also, the heat transfer ratio is improved.

As illustrated in FIG. 1, the airflow 1 flowing in from a left side, with the one-directional fin 7, flows in the heat exchanger core 2 obliquely within an area of an effective core height $H_1$.

On the other hand, in a case of the conventional-type fin 8, the airflow 1 flows in the heat exchanger core 2 as illustrated with a dotted line in a mountain-like shape within an area of the effective core height $H_2$ of the conventional-type. As clearly illustrated in FIG. 1, the effective core height $H_2$ of the conventional-type is higher than the effective core height $H_1$ of the one-directional fin of the present invention. Therefore, in FIG. 1, one-directional fin is adopted to generate the increase ΔH of the air-flow reduced region in the present invention. Thus, in the region of ΔH, the heat transfer ratio is lowered.

Figure 4:
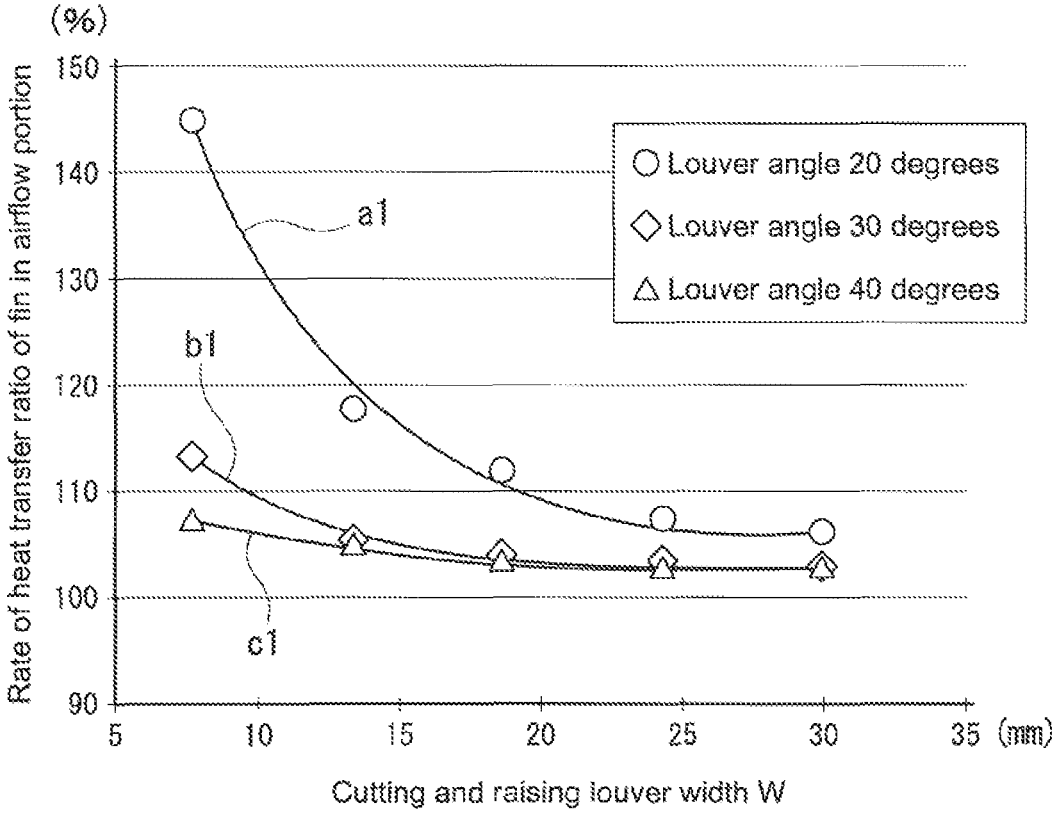
FIG. 4 illustrates experimental data in which the cutting and raising louver width W is set along a lateral axis, and a rate of a heat transfer ratio in a main heat transfer region (air-flow portion) between the core of the present invention and the conventional-type core is set along a vertical axis.

First of all, the present inventor experimentally obtains the heat transfer ratio at the effective core height $H_1$ of the one-directional fin illustrated in FIG. 1 as a rate relative to the conventional-type fin 8. FIG. 4 illustrates the experimental data. The cutting and raising louver width W is set along a lateral axis, and the rate of the heat transfer ratio is set along a vertical axis. Each experiment is attempted at 20 degrees, 30 degrees, and 40 degrees of a louver angle.

As clearly illustrated in FIG. 4, within the area of the effective core height $H_1$ at any angle, the rate of the heat transfer ratio higher than that of the conventional-type louver is indicated.

Figure 7:
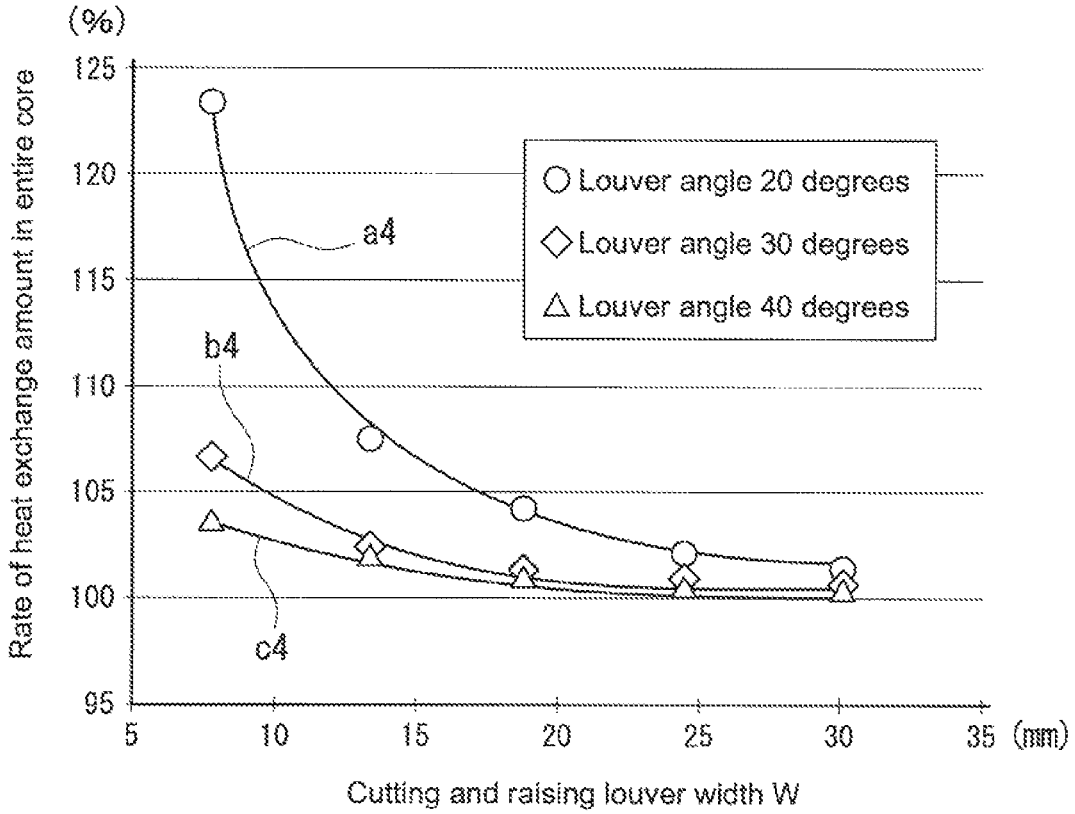
FIG. 7 is a graph in which the cutting and raising louver width W is set along a lateral axis, and a rate of a heat exchange amount between the heat exchanger core of the present invention and that of the conventional-type heat exchanger core.

Further, FIG. 7 indicates the rate between the cutting and raising louver width W and the amount of the heat exchange in an entire core.

The data is regression-analyzed, and $$Qup=Qup(W,\theta)=\alpha(W)+\beta(W,\theta)+1$$

are obtained.

Herein, $$\alpha(W)=\eta/(W-\eta),\text{ and }\eta=0.3553\text{ (mm)}$$

are to be satisfied. Further, $$\beta(W,\theta)=\xi/(W\cdot\tan^2 2\theta-\xi),\text{ and }\xi=0.5447\text{ (mm)}$$

are to be satisfied.

α(W) represents an effect of increase of the number of louvers. β(W,θ) represents an effect of disappearance of the stagnant region in the downstream side of the direction-converting portion.

Further,

*Qup*=(amount of the heat exchange per one corrugation of one-directional fins in the airflow portion)/(amount of the heat exchange per one corrugation of conventional-type fins in the airflow portion)

is to be satisfied.

Figure 5:
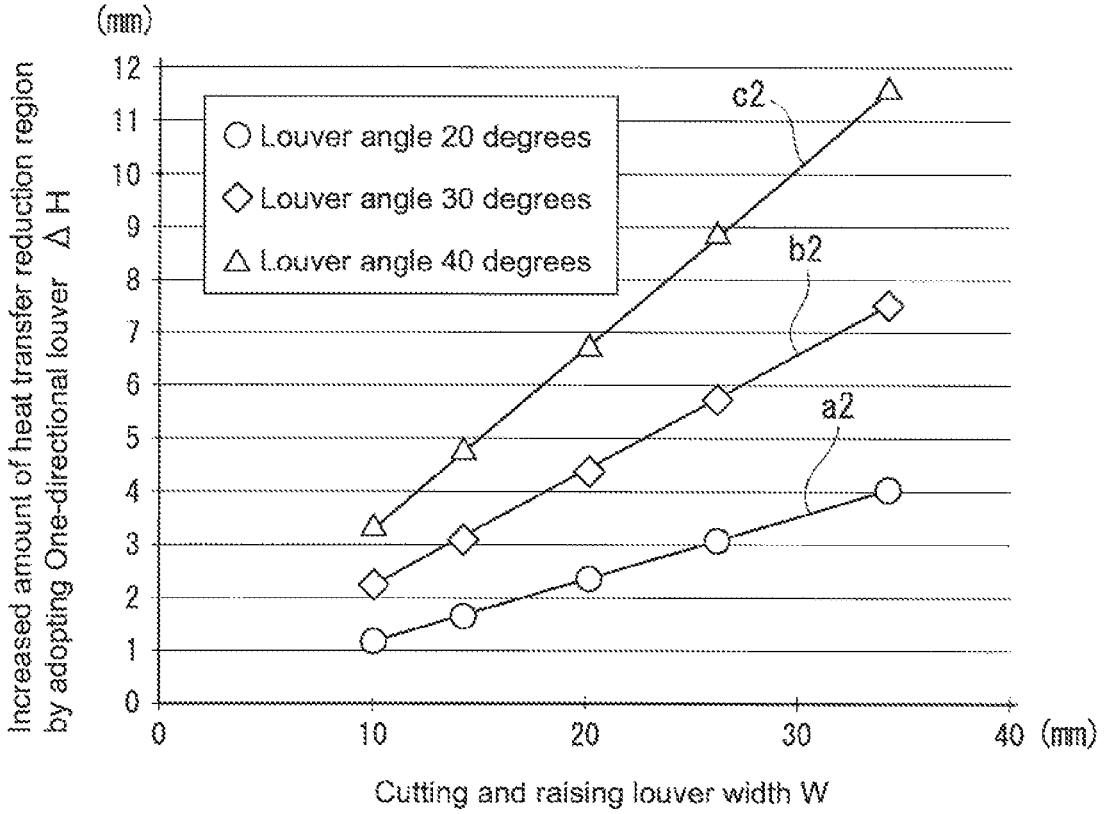
FIG. 5 is a graph in which the cutting and raising louver width W is set along a lateral axis, and an increased amount ΔH of the heat transfer reduction region (air-flow reduced region) of the core of the present invention, with respect to that of the conventional-type core, is set along a vertical axis.

Subsequently, as illustrated in FIG. 1, the present inventor experimentally confirms, by adopting one-directional fins, a region ΔH to be lost relative to the effective height $H_2$ of the conventional-type fin. FIG. 5 illustrates the data. In FIG. 5, the lateral axis expresses the cutting and raising louver width W of the core, and the vertical axis expresses the increased amount ΔH of the heat transfer reduction region by adopting the one-directional louver, and an each unit is mm.

Based on a flowing line by numeral-value calculation, the regression analysis is performed at each louver angle θ, and a regression equation (5)

$$\Delta H=\Delta H(W,\theta)=j\cdot W\cdot(\sin\theta+k\cdot\sin^2\theta)$$

(j=0.1419, k=4.2789)

are obtained.

Here, considering by comparing the advantage and the disadvantage between the one-directional louver and the conventional-type fin, the area in which the effects can be obtained is expressed as $$Qup\times(H-\Delta H)/H>1.$$

The above described equation is modified, and $$H>Qup/(Qup-1)\times\Delta H$$

is obtained.

Figure 6:
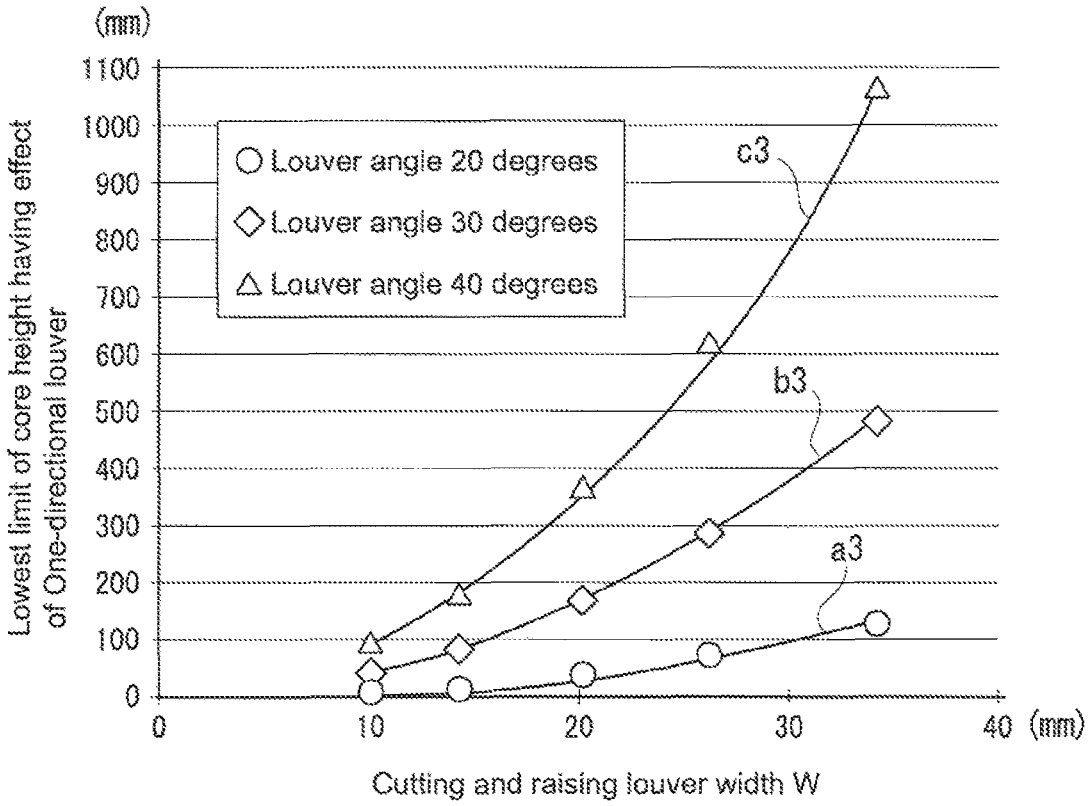
FIG. 6 is a graph in which the cutting and raising louver width W is set along a lateral axis, and a lowest limit of a core height having effects of the core of the present invention, with respect to that of the conventional-type core, is set along a vertical axis.

FIG. 6 illustrates the lowest limit (curve lines a3 to c3) of the effective height of the core of the one-directional louver obtained from the inequation.

As an example, in a case of the louver angle of 20 degrees, a value of the lowest limit for the cutting and raising width W of the louver is found on the curve line a3.

As long as the height of the core is kept to be the lowest limit value or more, the performance of the heat exchange higher than that of the conventional-type core can be obtained.

In a case of the louver angle of 30 degrees and 40 degrees, the higher performance is also obtained.

Therefore, in the heat exchanger core of one-directional louver, the H, W and θ may be set to satisfy $$H>Qup/(Qup-1)\times\Delta H. \quad (1)$$

Note that, according to the present invention, the cutting and raising louver width W is 6 to 46 mm, the cutting and raising louver angle θ is 20 degrees to 35 degrees, the pitch between the louvers is 0.5 to 1.5 mm, and the pitch between the fins is 2 to 5 mm. They are obtained based on discussion in which the airflow is adopted as the fluid and a flow speed at a front face of the core is set to 2 to 8 m/s.

The more preferable adopting condition is that the cutting and raising louver width W is 6 to 26 mm, the cutting and raising louver angle θ is 20 degrees to 30 degrees, the pitch between the louvers is 0.5 to 1.0 mm, and the pitch between the fins is 2 to 3 mm. The airflow is adopted as the fluid, and the flow speed at the front face of the core is set to 4 to 8 m/s.

REFERENCE SIGNS LIST

1 airflow
1*a* airflow
2 heat exchanger core
3 tank
4 flow passage of one-directional fin
5 flow passage of conventional-type fin
6 louver
6*a* louver
6*b* multi-directional louver
6*c* half louver
6*d* flat portion
7 one-directional fin
8 conventional-type fin
H core height
W cutting and raising louver width
θ cutting and raising louver angle

The invention claimed is:

1. A corrugated fin heat exchanger comprising a core and two tanks, wherein the core comprises a plurality of mutually parallel elongated tins and flat tubes, the flat tubes and the tins alternating with respect to each other, the tubes being configured for flow of a first fluid therethrough and the fins being configured for flow of a second fluid along the length of the fins from a first lengthwise end of the fins proximate a first lengthwise end of the core to a second lengthwise end of the fins proximate a second lengthwise end of the core and in contact with outer faces of the tubes, wherein the fins comprise one-directional louvers in the form of fin portions each cut out from a fire and the louvers being inclined in a same direction, wherein each of the two tanks is at a respective one of the ends of the core and end portions of the tubes pass through the tanks, and wherein an angle θ facing the first end of the core at which the louvers are inclined from the fins, W, and H are set to satisfy the inequation (1):

$$H>Qup/(Qup-1)\times\Delta H \quad (1)$$

wherein, $$Qup=Qup(W,\theta)=\alpha(W)+\beta(W,\theta)+1 \quad (2),$$

$$\alpha(W)=\eta/(W-\eta) \quad (3),$$

$$\beta(W,\theta)=\xi/(W\cdot\tan^2 2\theta-\xi) \quad (4),$$

$$\Delta H=\Delta H(W,\theta)=j\cdot W(\sin\theta+k\cdot\sin^2\theta) \quad (5),$$

$\eta$=0.3553 (mm), $\xi$=0.5447 (mm), j=0.1419, k=4.2789,

α and β are regression analysis coefficients,

θ is louver angle,

α(W) represents an effect of a greater of number of louvers oriented in a single direction in the core having one-directional louvers than in a core having two-directional louvers due to the absence of a multidirectional louver in t core having one-directional louvers, which, in a core having two-directional louvers, is interposed between sets of the louvers oriented in respective different directions, β(W,θ) represents an effect of absence, in the core having one-directional louvers, of a stagnant region which, in a core having two-directional louvers, occurs in a region immediately downstream from the multidirectional louver, H is a distance in mm between the two tanks, which is the actual height of the core, ΔH is the difference ($H_2-H_1$) between effective core height ($H_1$) of the corrugated fin heat exchanger having one-directional louvers and an actual core height and a corrugated fin heat exchanger having a same actual core height H but having multi-directional louvers wherein the fins comprise respective sets of louvers inclined in opposite directions, Qup is a ratio of an amount of heat exchanged per corrugation of the corrugated heat exchanger having one-directional louvers and the amount of heat exchanged per corrugation of the corrugated heat exchanger having multi-directional louvers, and W is an aggregate width in mm of the louvers.

* * * * *